US009430967B2

(12) United States Patent
In et al.

(10) Patent No.: US 9,430,967 B2
(45) Date of Patent: Aug. 30, 2016

(54) PIXEL AND ORGANIC LIGHT EMITTING DISPLAY USING THE SAME

(71) Applicant: Samsung Display Co., Ltd., Yongin, Gyeonggi-Do (KR)

(72) Inventors: Hai-Jung In, Yongin (KR); Yong-Sung Park, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 25 days.

(21) Appl. No.: 14/203,333

(22) Filed: Mar. 10, 2014

(65) Prior Publication Data

US 2014/0333515 A1 Nov. 13, 2014

(30) Foreign Application Priority Data

May 8, 2013 (KR) ..... 10-2013-0051728

(51) Int. Cl.
*G09G 3/32* (2016.01)

(52) U.S. Cl.
CPC .... *G09G 3/3233* (2013.01); *G09G 2300/0852* (2013.01); *G09G 2300/0861* (2013.01)

(58) Field of Classification Search
USPC ..... 345/76, 82, 211, 212, 690, 699
See application file for complete search history.

(56) References Cited

U.S. PATENT DOCUMENTS

2006/0139258 A1* 6/2006 Choi ..... G09G 3/3208 345/76
2007/0120780 A1* 5/2007 Park et al. ..... 345/76
2010/0013868 A1* 1/2010 Chung ..... 345/690
2010/0045646 A1* 2/2010 Kishi ..... 345/211
2011/0109531 A1* 5/2011 Choi ..... G09G 3/3233 345/76
2011/0175882 A1* 7/2011 Stryakhilev ..... G09G 3/3233 345/211
2011/0205206 A1* 8/2011 Yoo et al. ..... 345/211
2011/0227505 A1 9/2011 Park et al.
2012/0113077 A1* 5/2012 Kang ..... G09G 3/003 345/211
2013/0002633 A1* 1/2013 Chung ..... 345/211
2014/0049531 A1* 2/2014 Kwak ..... G09G 1/005 345/211
2014/0118229 A1* 5/2014 Han ..... G09G 3/3233 345/82
2014/0139502 A1* 5/2014 Han ..... G09G 3/3233 345/212
2015/0077414 A1* 3/2015 Yoo et al. ..... 345/212

FOREIGN PATENT DOCUMENTS

KR 10-2011-0104705 A 9/2011
KR 10-2012-0048294 A 5/2012

* cited by examiner

*Primary Examiner* — Thuy Pardo
(74) *Attorney, Agent, or Firm* — Knobbe Martens Olson & Bear LLP

(57) ABSTRACT

A pixel for an organic light emitting diode (OLED) display is disclosed. One inventive aspect includes an organic light emitting diode, a first transistor, a first capacitor, a second transistor and a second capacitor. The first transistor is configured to control an amount of current flowing from a first power source to a second power source via the organic light emitting diode in response to a voltage of a first node. The first capacitor is connected to a data line and has a first terminal. The second transistor is connected to a second terminal of the first capacitor and a second node and is configured to be turned on when a scan signal is supplied to a scan line. The second capacitor is connected to the second and first nodes.

21 Claims, 6 Drawing Sheets

PIXEL AND ORGANIC LIGHT EMITTING DISPLAY USING THE SAME

CROSS-REFERENCE TO RELATED APPLICATIONS

This application claims priority to and the benefit of Korean Patent Application No. 10-2013-0051728, filed on May 8, 2013, in the Korean Intellectual Property Office, the entire contents disclosed technology of which are incorporated herein by reference in their entirety.

BACKGROUND

1. Field

The disclosed technology relates generally to a pixel and more particularly, to an organic light emitting display using the pixel for improving display quality.

2. Description of the Related Technology

Recently, various flat panel display technologies have been developed which have less weight and volume than traditional bulky and heavy cathode ray tube (CRT) displays. Such flat panel technologies include liquid crystal display, field emission display, plasma display panel, organic light emitting diode display among others.

Among these displays, OLED technology displays images using organic light emitting diodes that generate light by recombining electrons and holes. These displays are characterized by fast response speed and low power consumption.

SUMMARY OF CERTAIN INVENTIVE ASPECTS

One inventive aspect relates to a pixel and an organic light emitting display using the same, which can improve display quality.

In one exemplary embodiment, according to one aspect of the present disclosure, a pixel includes an organic light emitting diode, a first transistor and a second transistor. The first transistor is configured to control an amount of current flowing from a first power source to a second power source via the organic light emitting diode in response to a voltage of a first node. The second transistor is electrically connected to the first node and a data line and is configured to be turned on and compensate a threshold voltage of the first transistor when a scan signal is supplied to a scan line.

In an exemplary implementation of the pixel, the pixel further includes a third transistor connected to the second node and the data line. A turn-on period of the third transistor does not overlap with a turn-on period of the second transistor.

In another exemplary implementation of the pixel, the pixel further includes a fourth transistor connected to the first power source and the second node, a fifth transistor connected to the first node and an initialization power source, a sixth transistor connected to a second electrode of the first transistor and the first node and a seventh transistor connected to the second electrode of the first transistor and an anode electrode of the organic light emitting diode. A turn-on period of the fourth transistor is configured not to overlap with a turn-on period of the third transistor. A turn-on period of the fifth transistor is configured to overlap with a turn-on period of the third transistor. A turn-on period of the sixth transistor is configured to partially overlap with a turn-on period of at least one of the third and second transistors. The seventh transistor is configured to be turned on or turned off simultaneously with the fourth transistor.

In another exemplary implementation of the pixel, the pixel further includes an eighth transistor connected to the initialization power source and the anode electrode of the organic light emitting diode. The eighth transistor is configured to be turned on or turned off simultaneously with the fifth transistor.

In another exemplary implementation of the pixel, the pixel further includes a fourth transistor connected to the second node and the initialization power source, a fifth transistor connected to the first node and the initialization power source, a sixth transistor connected to the second electrode of the first transistor and the first node, and a seventh transistor connected to the second electrode of the first transistor and the anode electrode of the organic light emitting diode. A turn-on period of the fourth transistor is configured not to overlap with a turn-on period of the third transistor. A turn-on period of the fifth transistor is configured to overlap with a turn-on period of the third transistor. A turn-on period of the sixth transistor is configured to partially overlap with at least one a turn-on period of at least one of the third transistor and the second transistor. The seventh transistor is configured to be simultaneously turned on or turned off with the fourth transistor.

In another exemplary implementation of the pixel, the pixel further includes an eighth transistor connected to the initialization power source and the anode electrode of the organic light emitting diode. The eighth transistor is configured to be turned on or turned off simultaneously with the fifth transistor.

In another exemplary embodiment, according to one inventive aspect of the disclosed technology, there disclosed is an organic light emitting display, the organic light emitting display including pixels positioned in an area defined by scan lines and data lines, a scan driver configured to drive the scan lines, an emission control line connected to the pixels, a control driver configured to control a first control line, a second control line and a third control line, and a data driver configured to drive the data lines. Each of the pixels is positioned on a horizontal line and includes an organic light emitting diode, a first transistor and a second transistor. The first transistor is configured to control an amount of current flowing from a first power source to a second power source via the organic light emitting diode in response to a voltage of a first node. The second transistor is electrically connected to the first node and a data line and is configured to be turned on and compensate a threshold voltage of the first transistor when a scan signal is supplied to a scan line.

In another exemplary implementation of the organic light emitting display, each pixel further includes a third transistor connected to the second node and the data line, the third transistor being turned on when a second control signal is supplied to the second control line.

In another exemplary implementation of the organic light emitting display, each pixel further includes a fourth transistor connected to the first power source and the second node a fifth transistor connected to the first node and an initialization power source, a sixth transistor connected to a second electrode of the first transistor and the first node, and a seventh transistor connected to the second electrode of the first transistor and an anode electrode of the organic light emitting diode. The fourth transistor is configured to be turned off when an emission control signal is supplied to the emission control line and be turned on when an emission control signal is not supplied to the emission control line. The fifth transistor is configured to be turned on when a first control signal is supplied to the first control line. The sixth transistor is configured to be turned on when a third control signal is supplied to the third control line. The seventh transistor is configured to be turned off when the emission control signal is supplied to the emission control line and be turned on when the emission control signal is not supplied to the emission control line.

In another exemplary implementation of the organic light emitting display, the initialization power source is set to a voltage lower than that of the first power source. Each pixel further includes an eighth transistor connected to the initialization power source and the anode electrode of the organic light emitting diode. The eighth transistor is configured to be turned on when the first control signal is supplied to the first control line.

In another exemplary implementation of the organic light emitting display, each pixel may further include a fourth transistor connected to the second node and the initialization power source a fifth transistor connected to the first node and the initialization power source a sixth transistor connected to the second electrode of the first transistor and the first node and a seventh transistor connected to the second electrode of the first transistor and the anode electrode of the organic light emitting diode The fourth transistor is configured to be turned off when an emission control signal is supplied to the emission control line and be turned on when an emission control signal is not supplied to the emission control line. The fifth transistor is configured to be turned on when a first control signal is supplied to the first control line. The sixth transistor is configured to be turned on when a third control signal is supplied to the third control line. The seventh transistor is configured to be turned off when the emission control signal is supplied to the emission control line and be turned on when the emission control signal is not supplied to the emission control line.

In another exemplary implementation of the organic light emitting display, the initialization power source is set to a voltage lower than that of the first power source. Each pixel further includes an eighth transistor connected to the initialization power source and the anode electrode of the organic light emitting diode. The eighth transistor is configured to be turned on when the first control signal is supplied to the first control line.

In another exemplary implementation of the organic light emitting display, one frame period is divided into first to fourth periods. The control driver supplies the first control signal to the first control line during the first period, supplies the second control signal to the second control line during the first and second periods, and supplies the third control signal to the third control line during the second and third periods.

In another exemplary implementation of the organic light emitting display, the scan driver simultaneously supplies a scan signal to the scan lines during the third period, and progressively supply the scan signal to the scan lines during the fourth period.

In another exemplary implementation of the organic light emitting display, the data driver supplies a data signal to the data lines so as to be synchronized with the scan signal progressively supplied to the scan lines during the fourth period.

In another exemplary implementation of the organic light emitting display, the scan driver supplies the emission control signal to the emission control line during the first to third periods.

In another exemplary implementation of the organic light emitting display, the data driver supplies a first reference voltage to the data lines during the first and second periods, and supply a second reference voltage to the data lines during the third period.

BRIEF DESCRIPTION OF THE DRAWINGS

Exemplary embodiments will now be described more fully hereinafter with reference to the accompanying drawings; however, they may be embodied in different forms and should not be construed as limited to the embodiments set forth herein. Rather, these embodiments are disclosed so that this disclosed technology will be thorough and complete, and will fully convey the scope of the exemplary embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION OF CERTAIN INVENTIVE EMBODIMENTS

Figure 1:
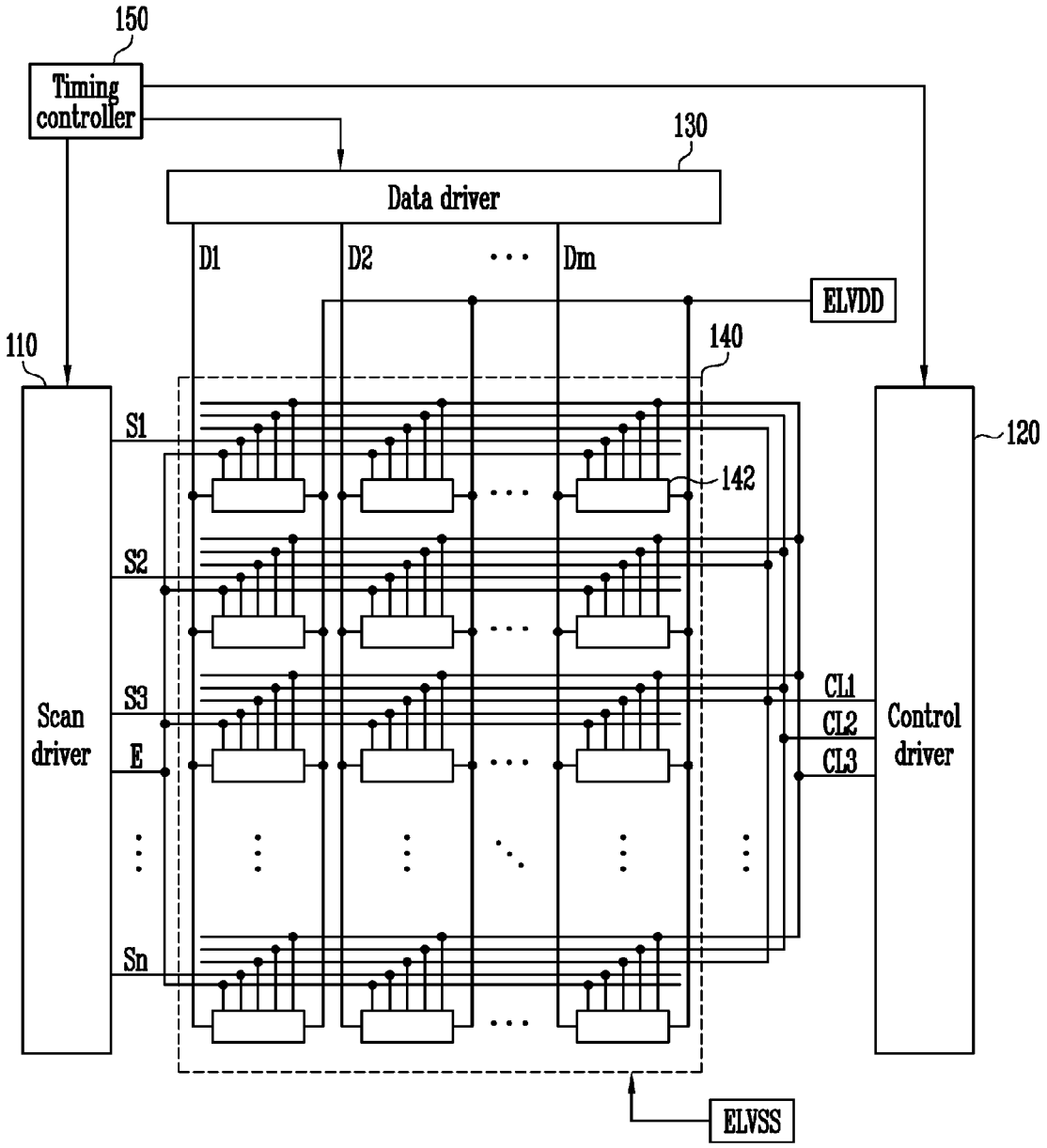
FIG. 1 is a block diagram illustrating an organic light emitting display according to an exemplary embodiment.

Hereinafter, certain exemplary embodiments according to the disclosed technology will be described with reference to the accompanying drawings, in which exemplary embodiments of the disclosed technology are shown. As those skilled in the art would realize, the described embodiments may be modified in various different ways, all without departing from the spirit or scope of the disclosed technology.

The drawings and description are to be regarded as illustrative in nature and not restrictive. Like reference numerals designate like elements throughout the specification.

Further, since sizes and thicknesses of constituent members shown in the accompanying drawings are arbitrarily given for better understanding and ease of description, the disclosed technology is not limited to the illustrated sizes and thicknesses.

In the drawings, the thickness of layers, films, panels, regions, etc., are exaggerated for clarity. In the drawings, for better understanding and ease of description, the thicknesses of some layers and areas are exaggerated. It will be understood that when an element such as a layer, film, region, or substrate is referred to as being "on" another element, it may be directly on the other element or intervening elements may also be present.

In addition, unless explicitly described to the contrary, the word "comprise" and variations such as "comprises" or "comprising" will be understood to imply the inclusion of stated elements but not the exclusion of any other elements. Throughout this specification, it is understood that the term "on" and similar terms are used generally and are not necessarily related to a gravitational reference.

In addition, in the accompanying drawings, an organic light emitting diode (OLED) display is illustrated as an active matrix (AM)-type OLED display in a 6Tr-1Cap structure in which six thin film transistors (TFTs) and one capacitor are formed in one pixel, but the disclosed technology is not limited thereto. Therefore, the OLED display may have various structures. For example, a plurality of TFTs and at least one capacitor may be provided in one pixel of the OLED display, and separate wires may be further provided in the OLED display. Here, the pixel refers to a minimum unit for displaying an image, and the OLED display displays an image by using a plurality of pixels.

Here, when a first element is described as being connected to a second element, the first element may be not only directly connected to the second element but may also be indirectly connected to the second element via a third element. Further, some of the elements that are not essential to the complete understanding of the disclosed technology are omitted for clarity. Also, like reference numerals refer to like elements throughout.

FIG. 1 is a block diagram illustrating an organic light emitting display according to an exemplary embodiment.

Referring to FIG. 1, the organic light emitting display according to this embodiment includes a pixel unit 140, a scan driver 110, a control driver 120, a data driver 130, and a timing controller 150. The pixel unit 140 may include pixels 142 positioned in an area defined by scan lines S1 to Sn and data lines D1 to Dm. The scan driver 110 is configured to drive the scan lines S1 to Sn and an emission control line E. The control driver 120 is configured to drive a first control line CL1, a second control line CL2 and a third control line CL3. The data driver 130 is configured to the data lines D1 to Dm. The timing controller 150 is configured to control the scan driver 110, the control driver 120 and the data driver 130.

In an exemplary implementation, the scan driver 110 supplies a scan signal to the scan lines S1 to Sn. As a nonlimiting example shown in FIG. 3, the scan driver 110 may simultaneously supply the scan signal to the scan lines S1 to Sn during a third period T3 in one frame 1F. The scan driver 110 may also progressively supply the scan signal to the scan lines S1 to Sn during a fourth period T4 in the frame 1F. The scan driver 110 may supply an emission control signal to the emission control line E. The emission control line E is connected to the pixels 142. For example, the scan driver 110 may supply the emission control signal to the emission control line E during at least one of a first period T1, a second period T2 and the third period T3 except the fourth period T4 in the frame 1F. In addition, a scan signal provided by the scan driver 110 is set to a voltage (e.g., a low voltage) at which one or more transistors of the pixels 142 are turned on. An emission control signal provided by the scan driver 110 is set to a voltage (e.g., a high voltage) at which the one or more transistors of the pixel 142 are turned off.

The control driver 120 may supply at least one of a first control signal, a second control signal and a third control signal to the first control line CL1, the second control line CL2 and the third control line CL3, respectively. The first control line CL1, the second control line CL2 and the third control line CL3 are commonly connected to the pixels 142. For example, the control driver 120 may supply the first control signal to the first control line CL1 during the first period T1 in the frame 1F, and supply the second control signal to the second control line CL2 during the first period T1 and the second period T2 in the frame 1F. The control driver 120 may supply the third control signal to the third control line CL3 during the second period T2 and the third period T3 in the frame 1F. In addition, at least one of the first control signal, the second control signal and the third control signal are set to a voltage (e.g., a low voltage) at which the one or more transistors of the pixels 142 are turned on.

The data driver 130 may supply a first reference voltage Vref1 to at least one of the data lines D1 to Dm during the first period T1 and the second period T2 in the frame 1F. The data driver 130 may supply a second reference voltage Vref2 to at least one of the data lines D1 to Dm during the third period T3 in the frame 1F. The data driver 130 may supply a data signal to at least one of the data lines D1 to Dm such that the data driver or at least one of the data lines D1 to Dm is synchronized with the scan signal during the fourth period T4 in the frame 1F. In addition, the data driver 130 may alternately supply left data signals and right data signals for each frame for a purpose of 3D driving.

Figure 3:
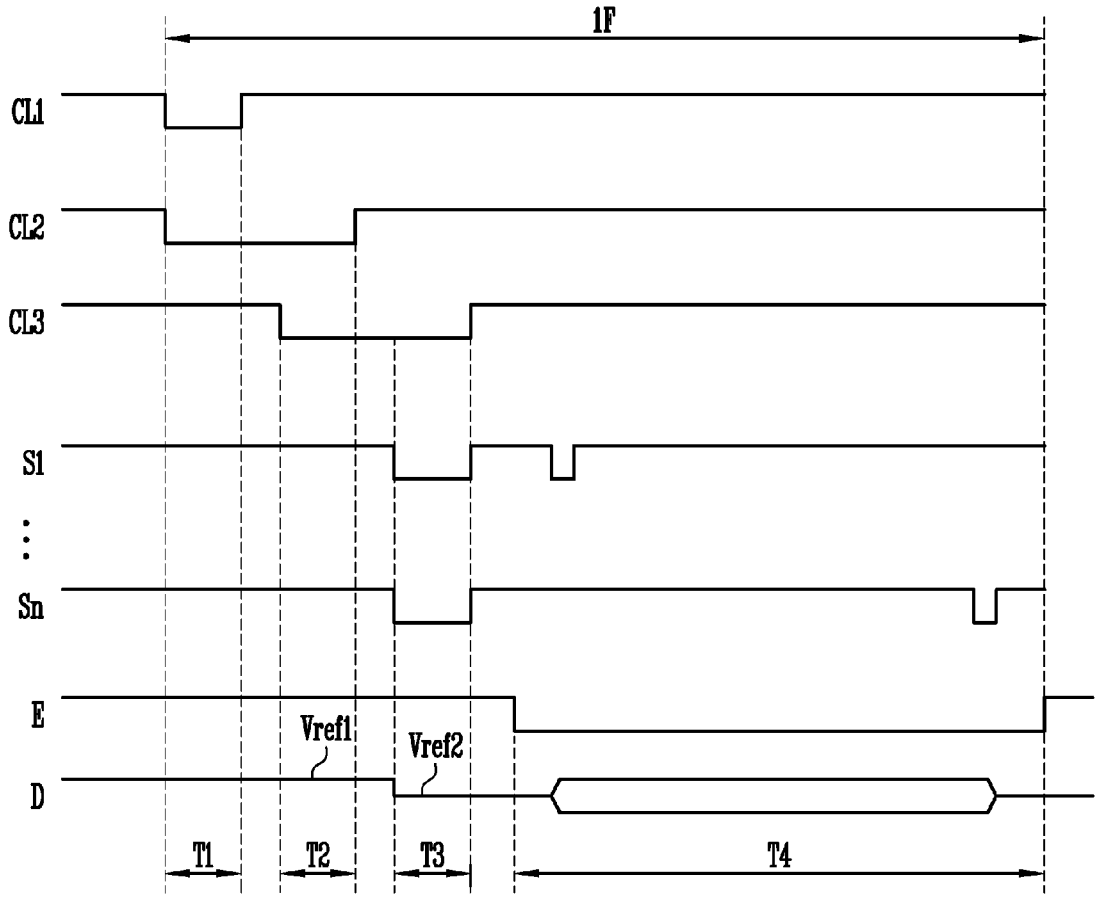
FIG. 3 is a waveform diagram illustrating an exemplary embodiment of a driving method of the pixel shown in FIG. 2.

Meanwhile, although it has been illustrated in FIG. 3 that the second reference voltage Vref2 has a value lower than the first reference voltage Vref1, the disclosed technology is not limited thereto. The first reference voltage Vref1 and the second reference voltage Vref2 are voltages at which gray scales are implemented together with the data signal. Furthermore, the first reference voltage Vref1 and the second reference voltage Vref2 may also be variously set in consideration of a size and/or a resolution of a panel, an expression ability of gray scales, etc.

The timing controller 150 may control at least one of the scan driver 110, the control driver 120 and the data driver 130 corresponding to a synchronization signal supplied from outside of the organic light emitting display.

The pixel unit 140 may include the pixels 142 and the pixels 142 is positioned in an area defined by at least one of the scan lines S1 to Sn and at least one of the data lines D1 to Dm. Each of the pixels 142 may implement a predetermined gray scale while an amount of current flowing from a first power source ELVDD to a second power source ELVSS via an organic light emitting diode (not shown) is controlled.

Meanwhile, although it has been illustrated in FIG. 1 that the emission control line E is connected to the scan driver 110 and the control lines CL1, CL2 and CL3 are connected to the control driver 120, the disclosed technology is not limited thereto. The emission control line E and at least one of the control lines CL1, CL2 and CL3 is connected to various drivers. As a nonlimiting example, each of the emission control line E and the control lines CL1, CL2 and CL3 are connected to the scan driver 110.

Figure 2:
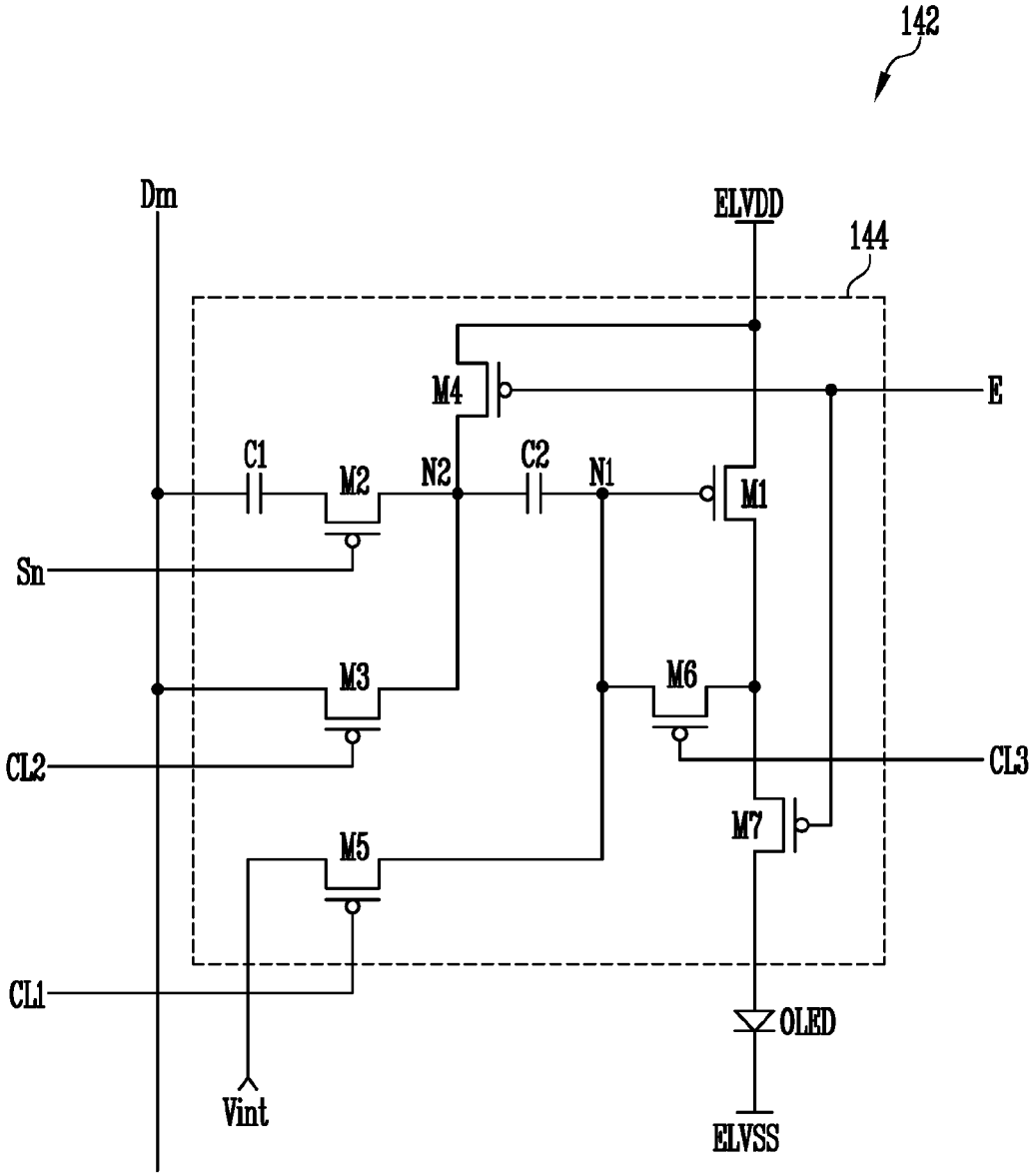
FIG. 2 is a circuit diagram illustrating a pixel according to a first exemplary embodiment of the disclosed technology.

FIG. 2 is a circuit diagram illustrating a pixel according to a first exemplary embodiment of the disclosed technology. As a non-limiting example, a pixel connected to an m-th data line Dm and an n-th scan line is shown in FIG. 2.

Referring to FIG. 2, each of the pixels 142 according to this exemplary embodiment includes an organic light emitting diode OLED and a pixel circuit 144. The pixel circuit 144 is configured to control an amount of current supplied to the organic light emitting diode OLED.

An anode electrode of the organic light emitting diode OLED is connected to the pixel circuit 144. A cathode electrode of the organic light emitting diode OLED is connected to the second power source ELVSS. The organic light emitting diode OLED may generate light with a predetermined luminance, corresponding to an amount of current supplied by the pixel circuit 144. The second power source ELVSS is set to a voltage lower than that of the first power source ELVDD so that current may flow through the organic light emitting diode OLED.

The pixel circuit 144 may control an amount of current supplied to the organic light emitting diode OLED in response to a data signal. The pixel circuit 144 may include a first transistor M1, a second transistor M2, a third transistor M3, a fourth transistor M4, a fifth transistor M5, a sixth transistor M6, a seventh transistor M7, a first capacitor C1 and a second capacitor C2.

A first electrode of the first transistor (i.e., a driving transistor) M1 is connected to the first power source ELVDD. A second electrode of the first transistor M1 is connected to a first electrode of the seventh transistor M7. A gate electrode of the first transistor M1 is connected to a first node N1. The first transistor M1 may control an amount of current supplied to the organic light emitting diode OLED in response to a voltage applied to the first node N1.

A first electrode of the second transistor M2 is connected to a second terminal of the first capacitor C1 and a second electrode of the second transistor M2 is connected to a second node N2. A gate electrode of the second transistor M2 is connected to the scan line Sn. The second transistor M2 is turned on when a scan signal is supplied to the scan line Sn such that the second terminal of the first capacitor C1 and the second node N2 are electrically connected to each other.

A first electrode of the third transistor M3 is connected to the data line Dm and a second electrode of the third transistor M3 is connected to the second node N2. A gate electrode of the third transistor M3 is connected to the second control line CL2. The third transistor M3 is turned on when a second control signal is supplied to the second control line CL2 such that the data line Dm and the second node N2 are electrically connected to each other.

A first electrode of the fourth transistor M4 is connected to the first power source ELVDD and a second electrode of the fourth transistor M4 is connected to the second node N2. A gate electrode of the fourth transistor M4 is connected to the emission control line E. The fourth transistor M4 is turned off when an emission control signal is supplied to the emission control line E. The fourth transistor M4 is turned on when the emission control signal is not supplied to the emission control line E.

A first electrode of the fifth transistor M5 is connected to the first node N1 and a second electrode of the fifth transistor M5 is connected to an initialization power source Vint. A gate electrode of the fifth transistor M5 is connected to the first control line CL1. The fifth transistor M5 is turned on when a first control signal is supplied to the first control line CL1 such that the fifth transistor M5 may supply the voltage of the initialization power source Vint to the first node N1. In addition, the initialization power source Vint is set to a voltage lower than that of the first power source ELVDD so that a threshold voltage of the first transistor M1 is compensated.

A first electrode of the sixth transistor M6 is connected to the second electrode of the first transistor M1 and a second electrode of the sixth transistor M6 is connected to the first node N1. A gate electrode of the sixth transistor M6 is connected to the third control line CL3. The sixth transistor M6 is turned on when a third control signal is supplied to the third control line CL3 such that the first transistor M1 is diode-connected.

The first electrode of the seventh transistor M7 is connected to the second electrode of the first transistor M1 and a second electrode of the seventh transistor M7 is connected to the anode electrode of the organic light emitting diode OLED. A gate electrode of the seventh transistor M7 is turned off when the emission control signal is supplied to the emission control line E. The gate electrode of the seventh transistor M7 is turned on when the emission control signal is not supplied to the emission control line E.

The first capacitor C1 is connected to the data line Dm and the first electrode of the second transistor M2. The first capacitor C1 may charge a voltage in response to a data signal during a period when the organic light emitting diode OLED emits light.

The second capacitor C2 is connected to the first node N1 and the second node N2. The second capacitor C2 is charged by a voltage in response to at least one of a voltage charged in the first capacitor C1 and the threshold voltage of the first transistor M1.

FIG. 3 is a waveform diagram illustrating an exemplary embodiment of a driving method of the pixel shown in FIG. 2.

Referring to FIG. 3, the frame 1F according to this embodiment is divided into a first period T1, a second period T2, a third period T3 and T4.

In an implementation, the first period T1 is an initialization period during which a voltage of the initialization power source Vint is applied to the first node N1. The second period T2 is a compensation period during which a voltage is charged in the second capacitor C2 and a voltage corresponds to a threshold voltage of the first transistor M1. The third period T3 is a data transmission period during which the second capacitor C2 is charged using a data signal of a previous period. The data signal is charged in the first capacitor C1. The fourth period T4 is an emission period during which an amount of current supplied to the organic light emitting diode OLED is controlled in response to a voltage charged in the second capacitor C2 and a data signal of the current frame and the current is stored in the first capacitor C1.

The emission control signal is supplied during at least one of the first period T1, the second period T2 and the third period T3. The emission control signal may not be supplied during the fourth period T4. At least one of the fourth transistor M4, the fifth transistor M5, the sixth transistor M6 and the seventh transistor M7 are turned off during at least one of the first period T1, the second period T2 and the third period T3 during which the emission control signal is supplied. If the fourth transistor M4 is turned off, the first power source ELVDD and the second node N2 are electrically decoupled from each other. If the seventh transistor M7 is turned off, the first transistor M1 and the organic light emitting diode OLED are electrically decoupled from each other. Thus, the organic light emitting diode OLED is set in a non-emission state during at least one of the first period T1, the second period T2 and the third period T3.

At least one of the fourth transistor M4, the fifth transistor M5, the sixth transistor M6 and the seventh transistor M7 are turned on during the fourth period T4 during which the emission control signal is not supplied. Then, the organic light emitting diode OLED and the first transistor M1 are electrically connected to each other and accordingly, the organic light emitting diode OLED may generate light with a predetermined luminance in response to an amount of current supplied to the first transistor M1.

The operation of the pixel will be described in detail. In an implementation, the first control signal is supplied to the first control line CL1 during the first period T1 and the second control signal may supplied to the second control line CL2 during the first and second periods T1 and T2.

If the first control signal is supplied to the first control line CL1, the fifth transistor M5 is turned on. If the fifth transistor M5 is turned on, a voltage of the initialization power source Vint is applied to the first node N1. If the second control signal is supplied to the second control line CL2, the third transistor M3 is turned on. If the third transistor M3 is turned on, the data line Dm and the second node N2 are electrically connected to each other. In this case, the first reference voltage Vref1 applied to the data line Dm is applied to the second node N2. That is, during the first period T1, a voltage at the first node N1 is initialized as a voltage of the initialization power source Vint and a voltage at the second node N2 is initialized as the first reference voltage Vref1. In addition, the first reference voltage Vref1 is set to be higher than the voltage of the initialization power source Vint.

After the voltages at the first and second nodes N1 and N2 are initialized, a supply of the first control signal to the first control line CL1 is stopped so that the fifth transistor M5 is turned off. Subsequently, the sixth transistor M6 is turned on by the third control signal. The third control signal is provided to the third control line CL3 during the second period T2 and the third period T3.

If the sixth transistor M6 is turned on, the first transistor M1 is diode-coupled. The diode-coupled first transistor M1 is turned on by a voltage of the initialization power source Vint. The voltage of the initialization power source Vint is applied to the first node N1. If the first transistor M1 is turned on, the voltage at the first node N1 can increase to a voltage obtained by subtracting the absolute threshold voltage of the first transistor M1 from the voltage of the first power source ELVDD.

Meanwhile, a supply of the second control signal to the second control line CL2 during the second period T2 and the third transistor M3 may maintain a turn-on state. Then, the first reference voltage Vref1 from the data line Dm is applied to the second node N2 during the second period T2. The second capacitor C2 may charge a voltage corresponding to the difference between the voltage at the first node N1 and the voltage at the second node N2. In addition, the first reference voltage Vref1 and the voltage of the first power source ELVDD are previously set to a predetermined value and hence a voltage stored in the second capacitor C2 is determined by the threshold voltage of the first transistor M1. That is, a voltage corresponding to the threshold voltage of the first transistor M1 is charged in the second capacitor C2 during the second period T2.

A supply of the second control signal to the second control line CL2 is stopped so that the third transistor M3 is turned off during the third period T3. During the third period T3, the supply of the third control signal to the third control line CL3 is maintained and the scan signal is supplied to the scan lines S1 to Sn. In addition, the second reference voltage Vref2 is applied to the data line Dm during the third period T3. Here, the second reference voltage Vref2 is set to be higher than the voltage of the initialization power source Vint.

If the scan signal is supplied to the scan line Sn, the second transistor M2 is turned on. If the second transistor M2 is turned on, the second terminal of the first capacitor C1 and the second node N2 are electrically connected to each other. In this case, the voltage at the second node N2 is set by a charge sharing between the first capacitor C1 and the second capacitor C2 as shown in Equation 1.

$$V_{N2} = \frac{C1(ELVDD + Vref2 - Vdata) + C2Vref1}{C1 + C2} \quad \text{Equation 1}$$

In Equation 1, Vdata denotes a voltage of a data signal of a previous frame. The voltage of the data signal is charged in the first capacitor C1.

Meanwhile, if a supply of the third signal to the third control line CL3 is maintained, the sixth transistor M6 may maintain a turn-on state. Thus, during the third period T3, the voltage at the first node N1 is substantially maintained as a voltage obtained by subtracting the absolute threshold voltage of the first transistor M1 from the voltage of the first power source ELVDD.

Subsequently, during the fourth period T4, the scan signal is progressively supplied to the scan lines S1 to Sn and the supply of the emission control signal to the emission control line E is stopped. If the supply of the emission control signal to the emission control line E is stopped, at least one of the fourth transistor M4 and the seventh transistor M7 is turned on.

If the fourth transistor M4 is turned on, the voltage of the first power source ELVDD is applied to the second node N2. In this case, the voltage at the first node N1 is set by coupling of the second capacitor C2 as shown in Equation 2.

$$V_{N1} = ELVDD - |VthM1| + ELVDD - \frac{C1(ELVDD + Vref2 - Vdata) + C2Vref1}{C1 + C2} = 2ELVDD - \frac{C1(ELVDD + Vref2 - Vdata) + C2Vref1}{C1 + C2} - |VthM1| \quad \text{Equation 2}$$

In Equation 2, VthM1 denotes a threshold voltage of the first transistor M1.

If the seventh transistor M7 is turned on, the first transistor M1 and the anode electrode of the organic light emitting diode OLED are electrically connected to each other. In this case, the current flowing through the organic light emitting diode OLED, corresponding to the voltage applied to the first node N1, is set as shown in Equation 3.

$$I = \frac{1}{2}\mu C_{ox}\frac{W}{L}(ELVDD - V_{N1} - |VthM1|)^2 = \frac{1}{2}\mu C_{ox}\frac{W}{L}\left[\frac{C1(Vref2 - Vdata) + C2Vref1 - C2ELVDD}{C1 + C2}\right]^2 \quad \text{Equation 3}$$

In Equation 3, μ denotes the mobility of the first transistor M1, $C_{ox}$ denotes the gate capacitance of the first transistor, W and L each denote the channel width and length ratio of the first transistor M1, respectively. Referring to Equation 3, current supplied to the organic light emitting diode OLED is determined regardless of a threshold voltage of the first transistor M1.

Meanwhile, if the scan signal is supplied to the scan line Sn during the fourth period T4, the second transistor M2 is turned on. If the second transistor M2 is turned on, the voltage of the first power source ELVDD is applied to the second terminal of the first capacitor C1. Then, the first capacitor C1 may charge a voltage corresponding to a data signal of a current frame so as to be synchronized with the scan signal supplied to the scan line Sn. The data signal of the current frame is supplied to the data line Dm. Subsequently, if the supply of the scan signal to the scan line Sn is stopped, the second terminal of the first capacitor C1 is set in a floating state. Thus, a charged voltage is substantially maintained regardless of the data signal supplied to the data line Dm. In the disclosed technology, a predetermined image is implemented by repeating the aforementioned procedure.

Figure 4:
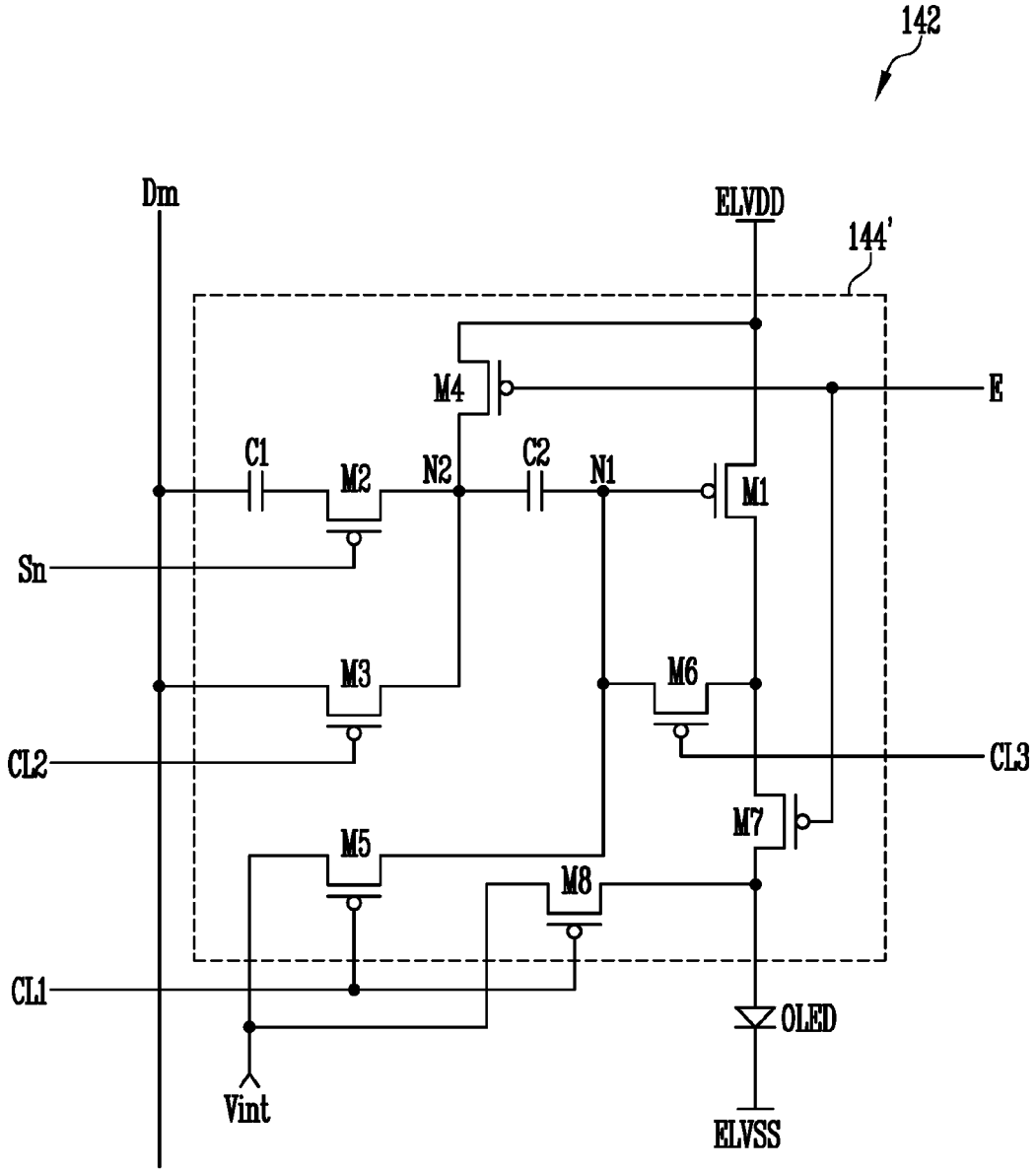
FIG. 4 is a circuit diagram illustrating a pixel according to a second exemplary embodiment of the disclosed technology.

FIG. 4 is a circuit diagram illustrating a pixel according to a second embodiment of the disclosed technology. In FIG. 4, components identical to those of FIG. 2 is designated by like reference numerals and their detailed descriptions will be omitted.

Referring to FIG. 4, the pixel 142 according to this embodiment includes a pixel circuit 144' and the organic light emitting diode OLED.

The pixel circuit 144' may further include an eighth transistor M8. The eighth transistor M8 is connected to the anode electrode of the organic light emitting diode OLED and the initialization power source Vint. The eighth transistor M8 is turned on when the first control signal is supplied to the first control line CL1 such that the eighth transistor M8 may supply a voltage of the initialization power source Vint to the anode electrode of the organic light emitting diode OLED.

That is, the eighth transistor M8 is turned on during the first period T1 such that the eighth transistor M8 may initialize the anode electrode of the organic light emitting diode OLED to be a voltage of the initialization power source Vint. An operation of a pixel of this embodiment, except the eighth transistor M8, is identical to that of the pixel of the first embodiment, and therefore, its detailed description will be omitted.

Figure 5:
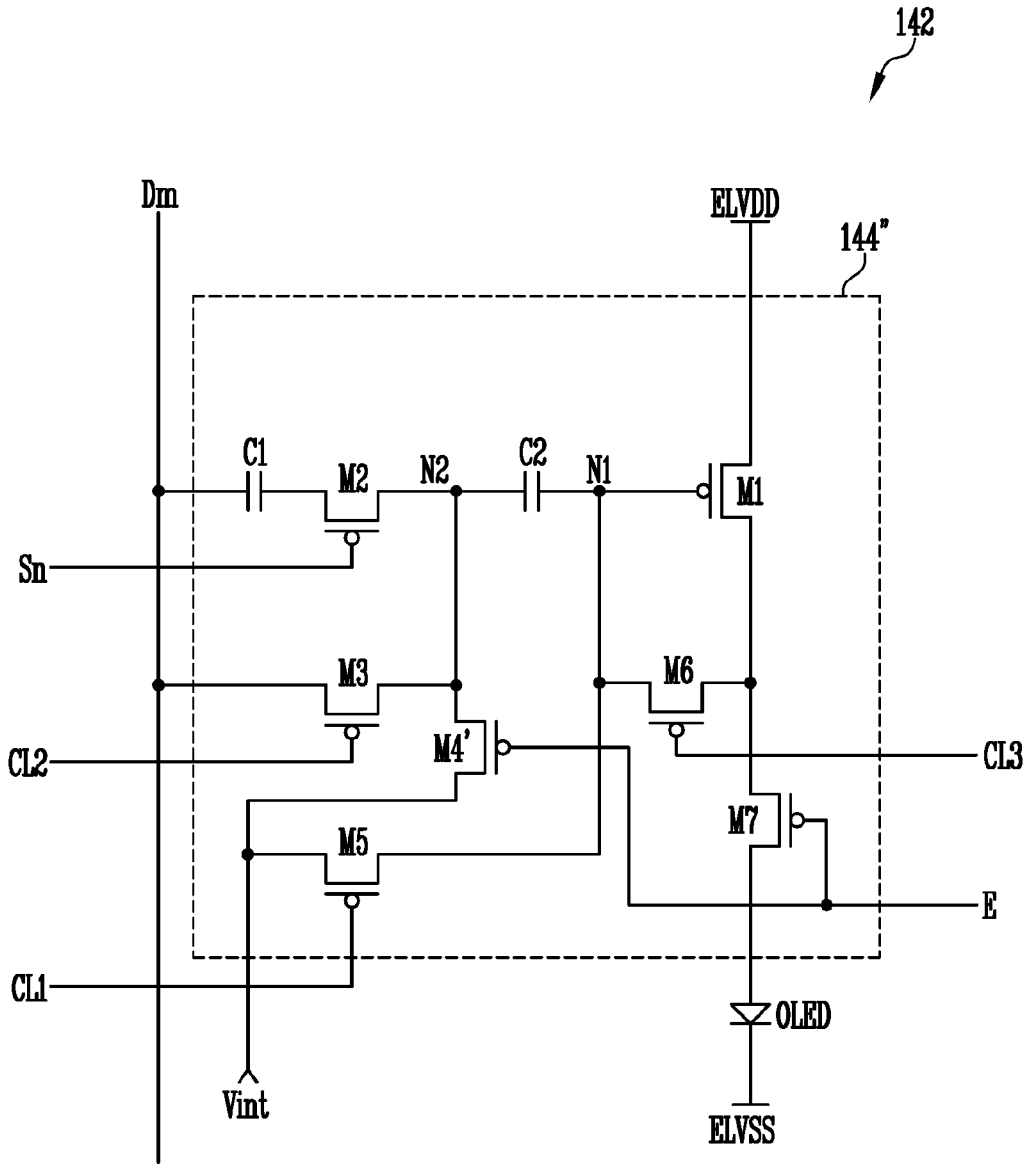
FIG. 5 is a circuit diagram illustrating a pixel according to a third exemplary embodiment of the disclosed technology.

FIG. 5 is a circuit diagram illustrating a pixel according to a third embodiment of the disclosed technology. In FIG. 5, components identical to those of FIG. 2 are designated by like reference numerals, and their detailed descriptions will be omitted.

Referring to FIG. 5, the pixel 142 according to this embodiment includes a pixel circuit 144" and the organic light emitting diode OLED.

The pixel circuit 144" may further include a fourth transistor M4'. The fourth transistor M4' is connected to the second node N2 and the initialization power source Vint. The fourth transistor M4' is turned off when the emission control signal is supplied to the emission control line E. The fourth transistor M4' is turned on when the emission control signal is not supplied to the emission control line E. In the pixel 142 according to this embodiment, the position of the fourth transistor M4' is changed, as compared with the first embodiment of FIG. 2.

An operation of the pixel 142 will be described in conjunction with FIGS. 3 and 5. Firstly, the fourth transistor M4' and the seventh transistor M7 are turned off by an emission control signal supplied to the emission control line E during at least one of the first period T1, the second period T2 and the third period T3. Then, the first transistor M1 and the organic light emitting diode OLED are electrically decoupled from each other during at least one of the first period T1, the second period T2 and the third period T3 and accordingly, the pixel 142 is set to be in a non-emission state.

During the first period T1, the first control signal is supplied to the first control line CL1 and the second control signal is supplied to the second control line CL2. If the first control signal is supplied to the first control line CL1, the fifth transistor M5 is turned on. If the fifth transistor M5 is turned on, the voltage of the initialization power source Vint is applied to the first node N1. If the second control signal is supplied to the second control line CL2, the third transistor M3 is turned on. If the third transistor M3 is turned on, the first reference voltage Vref1 from the data line Dm is applied to the second node N2. That is, during the first period T1, the first node N1 is initialized to be a voltage of the initialization power source Vint and the second node N2 is initialized to be the first reference voltage Vref1.

Subsequently, the sixth transistor M6 is turned on by the third control signal supplied to the third control line CL3 during the second period T2 and the third period T3. If the sixth transistor M6 is turned on, the first transistor M1 is diode-coupled and accordingly, the voltage at the first node N1 can increase to a voltage obtained by subtracting the absolute threshold voltage of the first transistor M1 from the voltage of the first power source ELVDD. Meanwhile, the third transistor M3 is set to be a turn-on state during the second period T2 and hence the first reference voltage Vref1 is applied to the second node N2. Thus, a voltage corresponding to the threshold voltage of the first transistor M1 is charged in the second capacitor C2 during the second period T2.

The supply of the second control signal to the second control line CL2 is stopped so that the third transistor M3 is turned off during the third period T3. During the third period T3, the supply of the third control signal to the third control line CL3 is maintained and the scan signal is supplied to the scan lines S1 to Sn. In addition, the second reference voltage Vref2 is applied to the data line Dm during the third period T3.

If the scan signal is supplied to the scan line Sn, the second transistor M2 is turned on. If the second transistor M2 is turned on, the second terminal of the first capacitor C1 and the second node N2 are electrically connected to each other. In this case, a voltage of the second node N2 is set by a charge sharing between the first and second capacitors C1 and C2 as shown in Equation 4.

$$V_{N2} = \frac{C1(Vint + Vref2 - Vdata) + C2Vref1}{C1 + C2} \qquad \text{Equation 4}$$

In Equation 4, Vdata denotes a voltage of a data signal of a previous frame. The voltage of the data signal is charged in the first capacitor C1.

Meanwhile, if the supply of the third control signal to the third control line CL3 is maintained, the sixth transistor M6 may maintain a turn-on state. Thus, during the third period T3, the voltage at the first node N1 is substantially maintained as a voltage obtained by subtracting the absolute threshold voltage from the voltage of the first power source ELVDD.

Subsequently, during the fourth period T4, the scan signal is progressively supplied to the scan lines S1 to Sn and a supply of an emission control signal to the emission control line E is stopped. If a supply of the emission control signal to the emission control line E is stopped, the fourth transistor M4' and the seventh transistor M7 are turned on.

If the fourth transistor M4' is turned on, a voltage of the initialization power source Vint is applied to the second node N2. In this case, a voltage of the first node N1 is set by coupling of the second capacitor C2 as shown in Equation 5.

$$V_{N1} = ELVDD - |VthM1| - \frac{C1(Vref2 - Vdata) + C2(Vref1 + Vint)}{C1 + C2} \quad \text{Equation 5}$$

In Equation 5, VthM1 denotes a threshold voltage of the first transistor M1.

If the seventh transistor M7 is turned on, the first transistor M1 and the anode electrode of the organic light emitting diode OLED are electrically connected to each other. In this case, current flowing through the organic light emitting diode OLED, corresponding to a voltage applied to the first node N1, is set as shown in Equation 6.

$$I = \frac{1}{2}\mu C_{ox}\frac{W}{L}(ELVDD - V_{N1} - |VthM1|)^2 = \frac{1}{2}\mu C_{ox}\frac{W}{L}\left[\frac{C1(Vref2 - Vdata) + C2(Vref1 - Vint)}{C1 + C2}\right]^2 \quad \text{Equation 6}$$

In Equation 6, μ denotes mobility of the first transistor M1, $C_{ox}$ denotes a gate capacitance of the first transistor, W and L denote the channel width and length ratio of the first transistor M1, respectively. Referring to Equation 6, current supplied to the organic light emitting diode OLED is determined regardless of the threshold voltage of the first transistor M1.

Meanwhile, if the scan signal is supplied to the scan line Sn during the fourth period T4, the second transistor M2 is turned on. If the second transistor M2 is turned on, a voltage of the initialization power source Vint is applied to the second terminal of the first capacitor C1. Then, the first capacitor C1 may store a voltage corresponding to a data signal of a current frame so that the first capacitor C1 is synchronized with the scan signal supplied to the scan line Sn. The data signal of the current frame is supplied to the data line Dm. Subsequently, if a supply of the scan signal to the scan line Sn is stopped, the second terminal of the first capacitor C1 is set as a floating state. Thus, a charged voltage is substantially maintained regardless of the data signal supplied to the data line Dm. In the disclosed technology, a predetermined image is implemented by repeating the aforementioned procedure.

Figure 6:
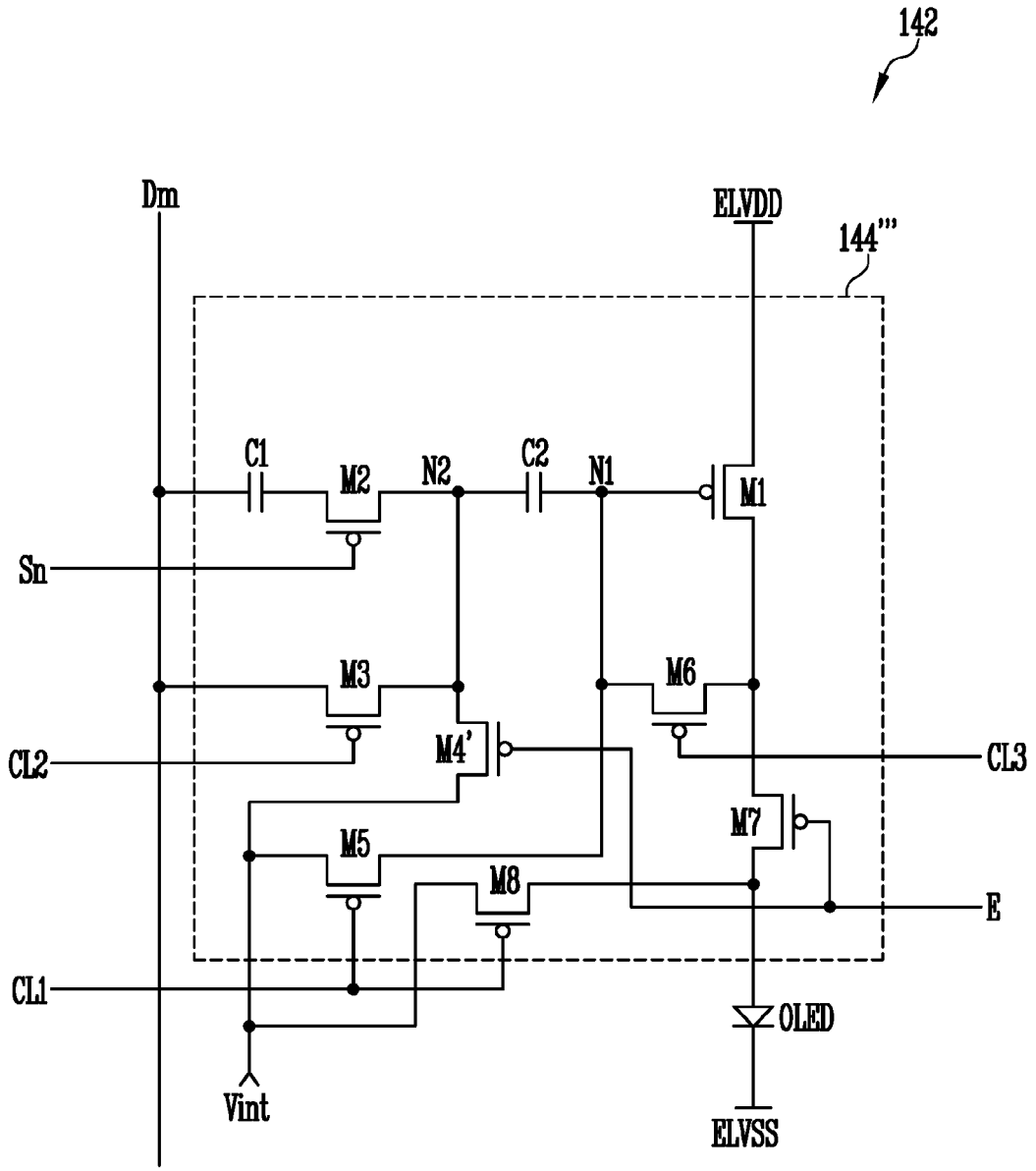
FIG. 6 is a circuit diagram illustrating a pixel according to a fourth exemplary embodiment of the disclosed technology.

FIG. 6 is a circuit diagram illustrating a pixel according to a fourth exemplary embodiment of the disclosed technology. In FIG. 6, components identical to those of FIG. 5 are designated by like reference numerals, and their detailed descriptions will be omitted.

Referring to FIG. 6, the pixel 142 according to this embodiment includes a pixel circuit 144''' and the organic light emitting diode OLED.

The pixel circuit 144''' may further include an eighth transistor M8. The eighth transistor M8 is connected to the anode electrode of the organic light emitting diode OLED and the initialization power source Vint. The eighth transistor M8 is turned on when the first control signal is supplied to the first control line CL1 so that the eighth transistor M8 may supply a voltage of the initialization power source Vint to the anode electrode of the organic light emitting diode OLED.

That is, the eighth transistor M8 is turned on during the first period T1 so that the voltage of the anode electrode of the organic light emitting diode OLED is initialized as the voltage of the initialization power source Vint. An operation of a pixel of this embodiment, except the eighth transistor M8, is identical to that of the pixel of the third embodiment, and therefore, its detailed description will be omitted.

Meanwhile, although it has been described in the disclosed technology that the transistors are shown as PMOS transistors for convenience of illustration, the disclosed technology is not limited thereto. In other words, the transistors are formed as NMOS transistors.

In the disclosed technology, an organic light emitting diode (OLED) may generate light of a specific color, corresponding to an amount of current supplied by a driving transistor. However, the disclosed technology is not limited thereto. For example, the organic light emitting diode (OLED) may generate white light, corresponding to another amount of current supplied by the driving transistor. In this case, a color image is implemented using a separate color filter or the like.

By way of summation and review, an organic light emitting display may include a plurality of pixels arranged in a matrix form at intersection portions of a plurality of data lines, a plurality of scan lines and a plurality of power lines. Each of the pixels may generally include an organic light emitting diode, two or more transistors. The two or more transistor may include a driving transistor and one or more capacitors.

In an implementation, an organic light emitting display has low power consumption. However, an amount of current flowing through an organic light emitting diode (OLED) of the organic light emitting display may depend on a variation of a threshold voltage of a driving transistor of each pixel and therefore, display inequality is caused. That is, characteristics of the driving transistor may change depending on manufacturing process variables of the driving transistor of each pixel. It is impossible for all transistors of an organic light emitting display to have a same characteristic in current process conditions. Accordingly, there occurs a variation in threshold voltage of the driving transistor.

In order to solve such a problem, there has been proposed a method of adding, to each pixel, a compensation circuit including a plurality of transistors and a capacitor. The compensation circuit of each pixel may charge a voltage in response to a threshold voltage of a driving transistor during one horizontal period and accordingly, a variation in the threshold voltage of the driving transistor is compensated.

Meanwhile, a method has recently been required, in which a compensation circuit is driven at a driving frequency of 120 Hz or more in order to prevent a motion blur phenomenon and/or to implement 3D images. However, in a case where the compensation circuit is driven at a high frequency of 120 Hz or more, a period required to charge a threshold voltage of a driving transistor is shortened and therefore, it is impossible to compensate for the threshold voltage of the driving transistor.

In the pixel and the organic light emitting display using the same according to the disclosed technology, the disclosed pixel can compensate for its threshold voltage by itself. In addition, an organic light emitting diode (OLED) display using the pixel can reserve a time period for compensating the threshold voltage and therefor, improve its display quality.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the disclosed technology as set forth in the following claims.

For purposes of summarizing the disclosed technology, certain aspects, advantages and novel features of the disclosed technology have been described herein. It is to be understood that not necessarily all such advantages may be achieved in accordance with any particular embodiment of the disclosed technology. Thus, the disclosed technology may be embodied or carried out in a manner that achieves or optimizes one advantage or group of advantages as taught herein without necessarily achieving other advantages as may be taught or suggested herein.

Various modifications of the above described embodiments will be readily apparent, and the generic principles defined herein may be applied to other embodiments without departing from the spirit or scope of the disclosed technology. Thus, the disclosed technology is not intended to be limited to the embodiments shown herein but is to be accorded the widest scope consistent with the principles and novel features disclosed herein.

What is claimed is:

1. A pixel for an organic light emitting display, the pixel comprising:

an organic light emitting diode;

a first transistor configured to control an amount of current flowing from a first power source to a second power source via the organic light emitting diode in response to a voltage at a first node;

a second transistor electrically connected to the first node and a data line, the second transistor configured to be turned on and compensate a threshold voltage of the first transistor when a scan signal is supplied to a scan line;

a first capacitor having a first terminal connected to the data line and a second terminal connected to the second transistor; and a second capacitor connected to the first node and to the second transistor at a second node, wherein the second capacitor is interposed between the first and second transistors.

2. The pixel of claim 1, further comprising a third transistor connected to the second node and the data line, wherein a turn-on period of the third transistor does not overlap with a turn-on period of the second transistor.

3. The pixel of claim 2, further comprising:

a fourth transistor connected to the first power source and the second node, wherein a turn-on period of the fourth transistor does not overlap with a turn-on period of the third transistor;

a fifth transistor connected to the first node and an initialization power source, wherein a turn-on period of the fifth transistor overlaps with a turn-on period of the third transistor;

a sixth transistor connected to a second electrode of the first transistor and the first node, wherein a turn-on period of the sixth transistor at least partially overlaps with one or more turn-on periods of at least one of the second transistor and the third transistor; and a seventh transistor connected to the second electrode of the first transistor and an anode electrode of the organic light emitting diode, the seventh transistor configured to be turned on or turned off simultaneously with the fourth transistor.

4. The pixel of claim 3, further comprising an eighth transistor connected to the initialization power source and the anode electrode of the organic light emitting diode, the eighth transistor configured to be turned on or turned off simultaneously with the fifth transistor.

5. The pixel of claim 2, further comprising:

a fourth transistor connected to the second node and the initialization power source, wherein a turn-on period of the fourth transistor does not overlap with a turn-on period of the third transistor;

a fifth transistor connected to the first node and the initialization power source, wherein a turn-on period of the fifth transistor overlaps with a turn-on period of the third transistor;

a sixth transistor connected to the second electrode of the first transistor and the first node, wherein a turn-on period of the sixth transistor at least partially overlaps with one or more turn-on periods of at least one of the second transistor and the third transistor; and a seventh transistor connected to the second electrode of the first transistor and the anode electrode of the organic light emitting diode, the seventh transistor configured to be turned on or turned off simultaneously with the fourth transistor.

6. The pixel of claim 5, further comprising an eighth transistor connected to the initialization power source and the anode electrode of the organic light emitting diode, the eighth transistor configured to be turned on or turned off simultaneously with the fifth transistor.

7. The pixel of claim 1, wherein the second transistor has a first electrode and a second electrode, and wherein the second capacitor is connected to a gate electrode of the first transistor and the second electrode of the second transistor.

8. The pixel of claim 1, wherein the second transistor has a first non-control electrode connected to the first capacitor and a second non-control electrode connected to the second capacitor.

9. An organic light emitting display, comprising:

one or more pixels positioned in an area defined by one or more scan lines and one or more data lines;

a scan driver configured to drive the scan lines;

an emission control line connected to the pixels;

a control driver configured to control a first control line, a second control and a third control line, the first, second and the third control lines connected to the pixels; and a data driver configured to drive the data lines, wherein each of the pixels is positioned on a horizontal line, each of the pixels including:

an organic light emitting diode;

a first transistor configured to control an amount of current flowing from a first power source to a second power source via the organic light emitting diode in response to a voltage at a first node;

a second transistor electrically connected to the first node and a data line, the second transistor configured to be turned on and compensate a threshold voltage of the first transistor when a scan signal is supplied to a scan line;

a first capacitor having a first terminal connected to the data line and a second terminal connected to the second transistor; and a second capacitor connected to the first node and to the second transistor at a second node, wherein the second capacitor is interposed between the first and second transistors.

10. The organic light emitting display of claim 9, wherein each of the pixels further includes a third transistor connected to the second node and the data line, the third transistor configured to be turned on when a second control signal is supplied to the second control line. supplied to the emission control line.

11. The organic light emitting display of claim 10, wherein each of the pixels includes:

a fourth transistor connected to the second node and the initialization power source, the fourth transistor configured to be turned off when the emission control signal is supplied to the emission control line and to be turned on when the emission control signal is supplied to the emission control line;

a fifth transistor connected to the first node and the initialization power source, the fifth transistor configured to be turned on when the first control signal is supplied to the first control line;

a sixth transistor connected to the second electrode of the first transistor and the first node, the sixth transistor configured to be turned on when the third control signal is supplied to the third control line; and a seventh transistor connected to the second electrode of the first transistor and the anode electrode of the organic light emitting diode, the seventh transistor configured to be turned off when the emission control signal is supplied to the emission control line and to be turned on when the emission control signal is not supplied to the emission control line.

12. The organic light emitting display of claim 11, wherein the initialization power source has a voltage lower than the first power source.

13. The organic light emitting display of claim 11, wherein each of the pixels further includes an eighth transistor connected to the initialization power source and the anode electrode of the organic light emitting diode, the eighth transistor configured to be turned on when the first control signal is supplied to the first control line.

14. The organic light emitting display of claim 9, wherein each of the pixels includes:

a fourth transistor connected to the first power source and the second node, the fourth transistor configured to be turned off when an emission control signal is supplied to the emission control line and to be turned on when the emission control signal is not supplied to the emission control line;

a fifth transistor connected to the first node and an initialization power source, the fifth transistor configured to be turned on when a first control signal is supplied to the first control line;

a sixth transistor connected to a second electrode of the first transistor and the first node, the sixth transistor configured to be turned on when a third control signal is supplied to the third control line; and a seventh transistor connected to the second electrode of the first transistor and an anode electrode of the organic light emitting diode, the seventh transistor configured to be turned off when the emission control signal is supplied to the emission control line and to be turned on when the emission control signal is not supplied to the emission control line.

15. The organic light emitting display of claim 14, wherein the initialization power source has a voltage lower than the first power source.

16. The organic light emitting display of claim 14, wherein each of the pixels further includes an eighth transistor connected to the initialization power source and the anode electrode of the organic light emitting diode, the eighth transistor configured to be turned on when the first control signal is supplied to the first control line.

17. The organic light emitting display of claim 9, wherein one frame period comprises at least a first period, a second period, a third period and a fourth period, wherein the control driver configured to supply the first control signal to the first control line during the first period, supply the second control signal to the second control line during the first period and the second period, and supply the third control signal to the third control line during the second period and the third period.

18. The organic light emitting display of claim 17, wherein the scan driver is configured to supply a scan signal to the scan lines during the third period and sequentially supply the scan signal to the scan lines during the fourth period.

19. The organic light emitting display of claim 18, wherein the data driver is configured to supply a data signal to the data lines so that the data driver is further configured to be synchronized with the scan signal sequentially supplied to the scan lines during the fourth period.

20. The organic light emitting display of claim 17, wherein the scan driver is configured to supply the emission control signal to the emission control line during the first period, the second period and the third period.

21. The organic light emitting display of claim 17, wherein the data driver is configured to supply a first reference voltage to the data lines during the first period and a second period and supply a second reference voltage to the data lines during the third period.

* * * * *